US005748078A

United States Patent [19]

Escolar

[11] Patent Number: 5,748,078

[45] Date of Patent: May 5, 1998

[54] ALARM ALERTING METHOD AND APPARATUS

[75] Inventor: Carlos Escolar, East Windsor, N.J.

[73] Assignee: AT&T Corp. Middletown, N.J.

[21] Appl. No.: 857,661

[22] Filed: May 16, 1997

[51] Int. Cl.[6] ..... G08B 29/12; G08B 27/00

[52] U.S. Cl. ..... 340/506; 340/527; 340/531; 340/635; 340/691

[58] Field of Search ..... 340/506, 527, 340/531, 691, 635

[56] References Cited

U.S. PATENT DOCUMENTS 4,692,742 9/1987 Raizen et al. ..... 340/531
5,166,664 11/1992 Fish ..... 340/531

*Primary Examiner*—Glen Swann

[57] ABSTRACT

A method and apparatus for alerting personnel in response to an alarm from an automated system. The monitoring system detects an alarm. Upon detection of the alarm, the monitoring system searches a list. The list includes contact numbers, wherein each contact number has a corresponding contact person, delay time, and a contact day and time for when each contact number should be used. A current day and time is matched with a contact day and time from the list. Upon a successful match, a contact person corresponding to the matched contact day and time is notified using a contact number corresponding to the matched contact day and time. If after a delay time corresponding to the matched contact day and time the alarm is not reset, a next contact number from the list having a contact day and time matching the current day and time is used to notify a contact person corresponding to the next contact day and time. A next contact number is selected and used from the list until the alarm is reset.

21 Claims, 3 Drawing Sheets

| NUMBER | DELAY | WHEN |
|---|---|---|
| JOHN'S BEEPER | 10 | MON-FRI: 0-24 |
| JOHN'S OFFICE | 12 | MON-FRI: 8-17 |
| JOHN'S HOME | 13 | MON-SUN: 0-8, 17-24 |
| MARY'S BEEPER | 15 | MON-FRI: 0-24 |
| MARY'S OFFICE | 20 | MON-FRI: 8-17 |

ALARM ALERTING METHOD AND APPARATUS

FIELD OF THE INVENTION

The invention relates to alarm systems in general. More particularly, the invention relates to a method and apparatus for alerting personnel to an alarm from a system that increases the probability that the underlying problem triggering the alarm will be corrected in a timely fashion.

BACKGROUND OF THE INVENTION

Innovations in the computer and telecommunications industry have led to an increase in the number of automated systems capable of running largely without human operators. For example, modern telecommunications switching systems automatically route hundreds of thousands of telephone calls from one transmission line to another transmission line. Predictably, these systems are extremely complex. Further, in some instances these systems provide critical services, such as the emergency police help line 911.

Consequently, software and hardware based systems have been established to monitor these automated systems, set off an alarm if any problems are detected, and to notify select human operators to correct the problem. These "monitoring" systems permitted many systems to operate without any human operators at all.

These systems are loosely referred to as "unattended" systems.

For example, if an automobile is running low on oil or gas, a warning light is turned on to inform the driver of the vehicle. A more sophisticated monitoring system may include a Messaging system that automatically dials a telephone number of a repair person, and may even provide a message with information concerning the problem.

The problem with the monitoring systems described above is that the Messaging system is unreliable. There is no assurance that a repair person has received proper notification of an alarm. For example, if a monitoring system is programmed to contact a repair person using a telephone number for a pager in response to an alarm, there is no way for the system to determine whether the page was ever received. It could be that the pager is not turned on, or has run out of batteries, is out of range, and so forth. Moreover, conventional monitoring systems are not capable of determining where an appropriate human operator might be located, and calling the human operator at the number corresponding to that location. In addition, conventional monitoring systems do not attempt to minimize the amount of time required to solve the problem forming the basis for the alarm, and also minimizing the inconvenience to the human operators.

In view of the foregoing, it can be appreciated that a substantial need exists for a monitoring system which solves the above-discussed problems.

SUMMARY OF THE INVENTION

These needs and other needs are met by a method and apparatus for alerting personnel in response to an alarm from an automated system. The monitoring system detects an alarm. Upon detection of the alarm, the monitoring system searches a list. The list includes contact numbers, wherein each contact number has a corresponding contact person, delay time, and a contact day and time for when each contact number should be used. A current day and time is matched with a contact day and time from the list. Upon a successful match, a contact person corresponding to the matched contact day and time is notified using a contact number corresponding to the matched contact day and time. If after a delay time corresponding to the matched contact day and time the alarm is not reset, a next contact number from the list having a contact day and time matching the current day and time is used to notify a contact person corresponding to the next contact day and time. A next contact number is selected and used from the list until the alarm is reset.

With these and other advantages and features of the invention that will become hereinafter apparent, the nature of the invention may be more clearly understood by reference to the following detailed description of the invention, the appended claims and to the several drawings attached herein.

DETAILED DESCRIPTION

Figure 1:
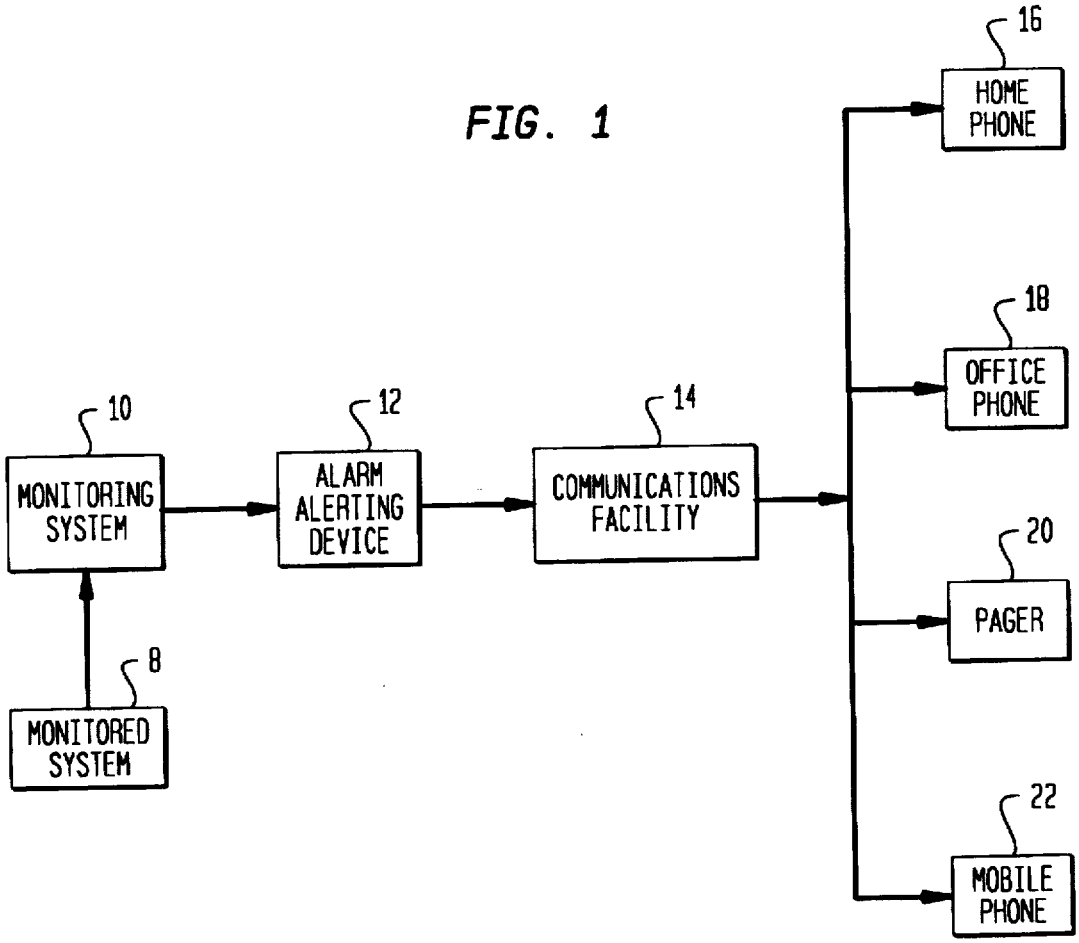
FIG. 1 shows a diagram of a system that is suitable practice the present invention.

Referring now in detail to the drawings wherein like parts are designated by like reference numerals throughout, there is illustrated in FIG. 1 a system that is suitable to practice the present invention. As shown in FIG. 1, a monitored system 8 is connected to a monitoring system 10, which is in turn connected to an alarm alerting device (AAD) 12. AAD 12 is connected to a communications facility 14. Communications facility 14 is connected to subscriber stations 16, 18, 20 and 22, that represent a residential telephone, office telephone, pager and mobile telephone, respectively.

Monitored system 8 can be any device or system in need of monitoring for problems, such as a telecommunications switch, computer, computer network, and so forth. Monitoring system 10 monitors monitored system 8 for problems. If a problem is detected, monitoring system 10 sends an alarm message to alarm alerting device 12. AAD 12 looks up an appropriate contact number for reaching select service or repair personnel for repairing the problem. Once the appropriate number is selected, AAD 12 initiates contact with communications facility 14 to establish a call connection with subscriber stations 16, 18, 20 and/or 22. Once a call connection is established, a message is delivered notifying the service personnel of the problem.

Figure 2:
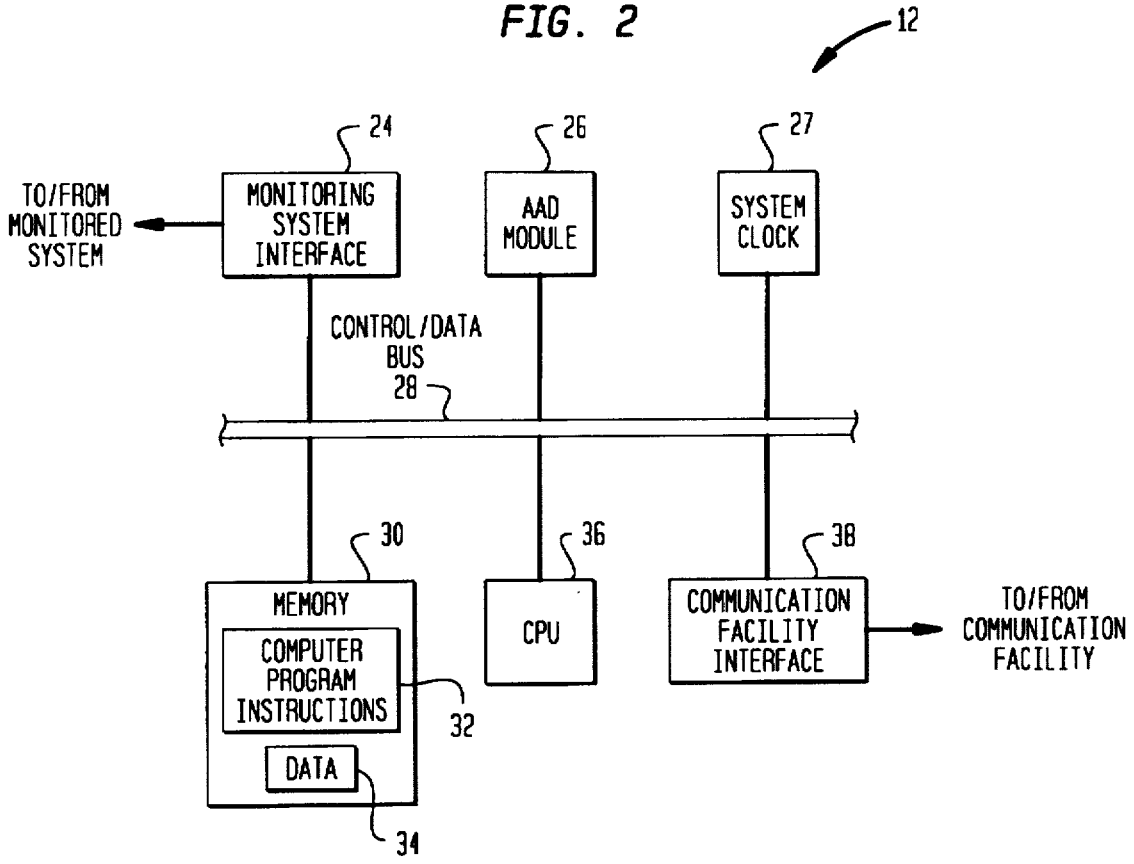
FIG. 2 is a block diagram of alarm alerting device 12 in accordance with one embodiment of the invention.

FIG. 2 is a block diagram of AAD 12 in accordance with one embodiment of the invention. FIG. 2 shows a monitoring system interface 24 in communication with monitoring system 10. Monitoring system interface 24 is connected to AAD module 26 via control/data bus 28. Also connected to control/data bus 28 is a computer memory 30, a central processing unit (CPU) 36, and a communications facility interface 38. Computer memory includes a set of computer program instructions 32 for execution by CPU 36, and data 34 on which the computer program instructions operate. CPU 36 can be any CPU capable of executing computer program instructions 32 at sufficient speed, such as the Intel Pentium™ family of processors. Communications facility interface 38 is in communication with communications facility 14.

Figure 3:
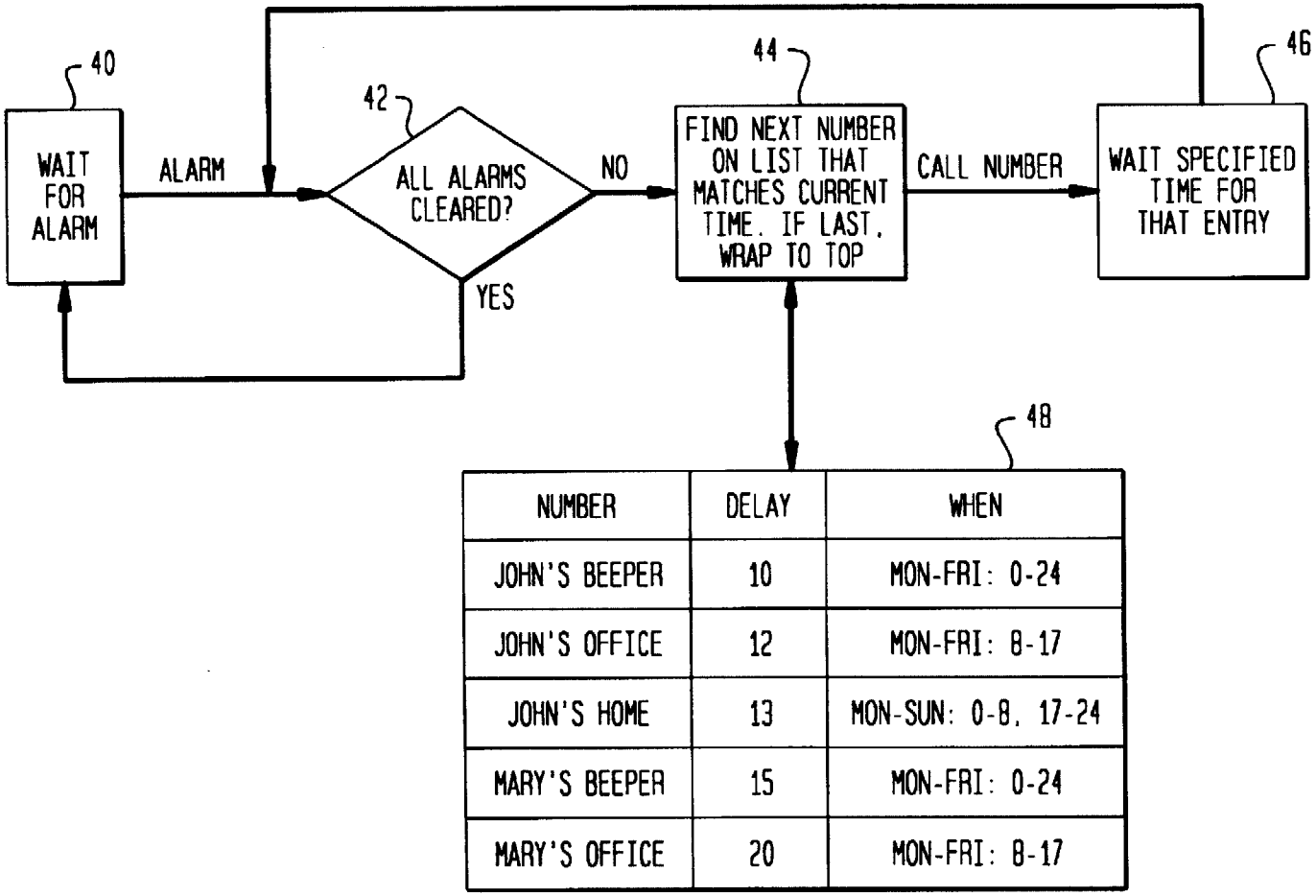
FIG. 3 is a block flow diagram of an alarm alerting device (AAD) module in accordance with a first embodiment of the invention.

FIG. 3 is a block flow diagram of an AAD module in accordance with one embodiment of the invention. As shown at step 40, AAD module 26 waits for an alarm signal from monitoring system 10. Once an alarm signal is detected, AAD module 26 checks to see if all alarm signals have been cleared at step 42. If all alarms have been cleared, AAD module 26 is placed in standby mode waiting to receive an alarm signal at step 40. If all alarms have not been cleared, AAD module 26 refers to a list 48 to find an appropriate contact number.

List 48 is a list of contact numbers to call in response to an alarm. Each entry on list 48 has a contact number, a predetermined amount of time to try using the contact number (referred to as a delay time or delay period), and a time period when the number should be used based on a day of the week (referred to as a contact day and time). Further, the list is ordered by which telephone numbers should be called in order of priority from first to last, based upon the contact day and time. This ordering increases the efficiency of the matching process described below.

An example of list 48 is shown in Table 1.

TABLE 1

| NUMBER | DELAY | WHEN |
|---|---|---|
| John's Beeper | 10 | Mon–Fri:0–24 |
| John's Office | 12 | Mon–Fri:8–17 |
| John's Home | 13 | Mon–Sun:0–8,17–24 |
| Mary's Beeper | 15 | Mon–Fri:0–24 |
| Mary's Office | 20 | Mon–Fri:8–17 |

As seen in Table 1, list 48 includes a contact number, a delay time, and a day and range of time when to contact the contact person corresponding to the contact number. List 48 may be stored as data 34 in memory 30.

The delay time for each contact number is in minutes, but may be in any time increment desired. The delay time may reflect the approximate time within which the contact person should reasonably answer given the contact time period and contact number. For example, if the contact time period indicates that a contact person's residential telephone number should be used as the contact number, the delay time may be increased to reflect the distance it may take the contact person to reach the automated system from his or her residence. In addition, the delay time may be modified or changed in response to the problem that triggered the alarm. For example, if the alarm was in response to a severe or emergency problem, the delay time could be shortened to ensure that the problem is solved in the shortest period of time, even if it meant risking the possibility that there might be responses from multiple contact persons. By way of contrast, if the alarm was for a relatively minor problem, the delay time may be increased to ensure that a single contact person responds to the alarm.

Another example might be that a particular problem initiating the alarm might require a particular contact person, and therefore the delay time might be increased to ensure that particular person has adequate time to correct the problem.

Thus, AAD 12 attempts to increase the probability that an appropriate contact person will be notified in the shortest period of time in order to correct the problem that generated the alarm. To accomplish this, AAD module 26 matches a current day and time generated from system clock 27 with a contact day and time from the list. Upon a successful match, a contact person corresponding to the matched contact day and time is notified using a contact number which also corresponds to the matched contact day and time. After waiting a predetermined period of time, i.e., the delay time corresponding to the matched contact day and time at step 46, AAD module 26 checks to see if all alarms have been cleared at step 42. An alarm is cleared when the problem initiating the alarm is corrected, and monitoring system 10 turns off or resets the alarm. If all alarms have not been cleared at step 42, steps 44 and 46 are repeated with the next matched contact day and time from list 48. This process continues until all alarms are cleared. If the last contact number in the list has been tried, and all alarms are not cleared at step 42, then the process begins again with the contact number at the beginning of list 48.

A second embodiment of the invention is described as follows. The second embodiment of the invention is similar to the first embodiment of the invention, except that instead of AAD module 26 attempting to match a current day and time generated from system clock 27 with a contact day and time from the list, list 48 is ordered according to contact person, contact number and contact day and time when the contact person is likely to be found, and AAD module 26 selects a contact number from list 48 in sequential order at step 44. AAD module 26 then uses the selected number to notify a contact person corresponding to the number at step 44. After waiting a delay time corresponding to the selected number at step 46, AAD module 26 checks to see if all alarms have been cleared at step 42. If all alarms have not been cleared at step 42, steps 44 and 46 are repeated using the next or subsequent contact number from list 48. This process continues until all alarms are cleared. If the last contact number in the list has been tried, and all alarms are not cleared at step 42, then the process begins again with the contact number at the beginning of list 48.

A third embodiment of the invention is described as follows. In this third embodiment of the invention, list 48 contains only a contact number and delay time. The delay time is established for each contact number in accordance with the principles discussed above, either initially during set-up of the list or in response to the problem conditions that initiated the alarm. AAD module 26 then determines whether all alarms have been cleared at step 42. If not, AAD module 26 uses the first number from list 48 to notify a contact person at step 44. After waiting the delay time corresponding to the contact number at step 46, AAD module 26 checks to see if all alarms have been cleared at step 42. If all alarms have not been cleared at step 42, steps 44 and 46 are repeated using the next or subsequent contact number from list 48. This process continues until all alarms are cleared. If the last contact number in the list has been tried, and all alarms are not cleared at step 42, then the process begins again with the contact number at the beginning of list 48.

Although various embodiments are specifically illustrated and described herein, it will be appreciated that modifications and variations of the present invention are covered by the above teachings and within the purview of the appended claims without departing from the spirit and intended scope of the invention. For example, although the time period for when a contact person is likely to be found is limited to day and time in the above described embodiments, it can be appreciated that the time period could include any other time periods such as weeks, months or even years.

What is claimed is:

1. A method for alerting personnel in response to an alarm signal from an automated system, comprising the steps of:

a. receiving the alarm;

b. searching a list of contact numbers, wherein each contact number has a corresponding contact person, delay time, and a contact day and time for when each contact number should be used;

c. matching a current day and time with a contact day and time from said list;

d. notifying a contact person corresponding to said matched contact day and time using a contact number corresponding to said matched day and time;

e. determining whether the alarm has been reset within a delay time corresponding to said matched contact day and time, and if not, repeating steps (c)(e) using a next contact number from said list having a contact day and time that matches said current day and time.

2. The method of claim 1, wherein said list has a first contact number and a last contact number, and if said last contact number is used and the alarm is not reset, said next number becomes said first contact number.

3. The method of claim 2, wherein the system is attended.

4. The method of claim 3, wherein said contact person notified using a contact number corresponding to at least one of a group comprising a pager number, residential telephone number, office telephone number and mobile telephone number.

5. The method of claim 3, wherein said unattended system is a telecommunications switch.

6. A method for alerting personnel in response to an alarm from an automated system, comprising the steps of:

a. ordering a list of contact numbers for contact personnel by a contact day and time for when each number should be used;

b. detecting the alarm;

c. selecting a contact number from said list;

d. notifying a contact person using said contact number;

e. determining whether the alarm has been reset within a delay time corresponding to said selected contact number, and if not, repeating steps (c)-(e) sing a next contact number from said list.

7. The method of claim 6, wherein said list has a first contact number and a last contact number, and if said last contact number is used and the alarm is not reset, said next number becomes said first contact number.

8. The method of claim 7, wherein the system is unattended.

9. The method of claim 8, wherein said contact person notified using a contact number corresponding to at least one of a group comprising a pager number, residential telephone number, office telephone number and mobile telephone number.

10. The method of claim 9, wherein said delay time may vary for each contact number.

11. The method of claim 10, wherein said unattended system is a telecommunications switch.

12. An apparatus for alerting personnel in response to an alarm generated by a monitoring system responsible for monitoring an automated system, comprising:

an alarm alerting device coupled to the monitoring system for receiving the alarm, said alarm alerting device selecting a contact number for a contact person corresponding to a day and time when said contact person is likely to be found;

a communications facility connected to said alarm alerting device for notifying said contact person using said selected contact number; and a subscriber unit for receiving said notification from said alarm alerting device via said communications facility.

13. The apparatus of claim 12, wherein said alarm alerting device comprises:

memory storing a list having contact numbers, wherein each contact number has a corresponding contact person, delay time, and a contact day and time for when each contact number should be used;

a system clock for determining a current day and time; and a comparator for comparing said current day and time with a contact day and time from said list, and selecting said compared contact day and time if it matches said current day and time.

14. The apparatus of claim 13, wherein said alarm alerting device further comprises a timer coupled to said system clock, wherein if said timer reaches a delay time corresponding to said selected contact number and the alarm has not been reset, said comparator selects a next contact day and time matching said current day and time, and a next contact number corresponding to said next contact day and time are used by said communication facility to notify a contact person corresponding to said next contact day and time.

15. The apparatus of claim 14, wherein said list has a first contact number and a last contact number, and if said last contact number is used and the alarm is not reset, said next contact number becomes said first contact number.

16. The apparatus of claim 15, wherein the system is unattended.

17. The apparatus of claim 16, wherein said subscriber unit corresponds to at least one of a group comprising a pager, residential telephone, office telephone and mobile telephone.

18. The apparatus of claim 17, wherein said delay time may vary for each contact number.

19. The apparatus of claim 18, wherein said unattended system is a telecommunications switch.

20. A method for alerting personnel in response to an alarm signal from an automated system, comprising the steps of:

a. receiving the alarm;

b. selecting a contact number from a list of contact numbers, wherein each contact number has a corresponding contact person and delay time;

c. notifying a contact person corresponding to said selected contact number using said selected contact number;

d. determining whether the alarm has been reset within a delay time corresponding to said contact number, and if not, repeating steps (b)–(d) using a next contact number from said list.

21. The method of claim 20, wherein said list has a first contact number and a last contact number, and if said last contact number is used and the alarm is not reset, said next number becomes said first contact number.

* * * * *